US011105529B2

(12) United States Patent
Shah et al.

(10) Patent No.: US 11,105,529 B2
(45) Date of Patent: Aug. 31, 2021

(54) MULTI-ZONE INDOOR CLIMATE CONTROL AND A METHOD OF USING THE SAME

(71) Applicant: Carrier Corporation, Farmington, CT (US)

(72) Inventors: Rajendra K Shah, Indianapolis, IN (US); Douglas W. Durnil, Noblesville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 1000 days.

(21) Appl. No.: 14/676,466

(22) Filed: Apr. 1, 2015

(65) Prior Publication Data

US 2015/0330656 A1 Nov. 19, 2015

Related U.S. Application Data

(60) Provisional application No. 61/993,579, filed on May 15, 2014.

(51) Int. Cl.
*F24F 11/70* (2018.01)
*F24F 11/30* (2018.01)
(Continued)

(52) U.S. Cl.
CPC ..... *F24F 11/70* (2018.01); *F24F 11/30* (2018.01); *F24F 11/54* (2018.01); *F24F 11/56* (2018.01);
(Continued)

(58) Field of Classification Search
CPC ..... F24F 11/0076; F24F 11/0034; F24F 11/0012; F24F 11/006; F24F 2011/0067;
(Continued)

(56) References Cited

U.S. PATENT DOCUMENTS 3,731,730 A 5/1973 Callahan
4,817,009 A 3/1989 Jensen et al.
(Continued)

FOREIGN PATENT DOCUMENTS

CN 201110695 Y 9/2008
CN 202294148 U 7/2012
(Continued)

OTHER PUBLICATIONS

Lu, Jiakang, et al. "The smart thermostat: using occupancy sensors to save energy in homes." Proceedings of the 8th ACM Conference on Embedded Networked Sensor Systems. ACM, 2010.*

*Primary Examiner* — Michael D Masinick
(74) *Attorney, Agent, or Firm* — Cantor Colburn LLP

(57) ABSTRACT

A system and method of conditioning air within a multi-zone system using a controller in communication with at least one sensor located within at least one of a plurality of zones, the method comprising the steps of: operating the at least one sensor to measure at least one environmental condition within at least one of the plurality of zones, identifying which, if any, of the plurality of zones is occupied, determining whether a demand condition exists within at least one occupied zone, calculating the difference between an actual environmental condition and a desired environmental condition within the plurality of zones to create a zone demand value if a demand condition exists in two or more occupied zones, and determining whether a cumulative zone demand value is equal to a zone balance point value.

28 Claims, 2 Drawing Sheets

(51) Int. Cl.

| | |
|---|---|
| *F24F 11/56* | (2018.01) |
| *F24F 11/54* | (2018.01) |
| *F24F 140/50* | (2018.01) |
| *F24F 120/10* | (2018.01) |
| *F24F 110/10* | (2018.01) |
| *F24F 140/60* | (2018.01) |

(52) U.S. Cl.
CPC ..... *F24F 2110/10* (2018.01); *F24F 2120/10* (2018.01); *F24F 2140/50* (2018.01); *F24F 2140/60* (2018.01)

(58) Field of Classification Search
CPC ..... F24F 2011/0068; F24F 2011/0046; F24F 2011/0047
See application file for complete search history.

(56) References Cited

U.S. PATENT DOCUMENTS

| | | | | |
|---|---|---|---|---|
| 5,341,988 | A * | 8/1994 | Rein | G05D 23/1934 236/49.3 |
| 5,348,078 | A | 9/1994 | Dushane et al. | |
| 5,361,982 | A | 11/1994 | Liebl et al. | |
| 6,349,883 | B1 * | 2/2002 | Simmons | F24F 11/006 165/209 |
| 7,177,728 | B2 | 2/2007 | Gardner | |
| 8,558,179 | B2 * | 10/2013 | Filson | G05D 23/1902 236/1 C |
| 8,695,888 | B2 * | 4/2014 | Kates | F24F 11/006 236/49.3 |
| 8,843,239 | B2 * | 9/2014 | Mighdoll | F24F 11/0012 236/91 D |
| 9,291,359 | B2 * | 3/2016 | Fadell | G05D 23/1902 |
| 9,618,223 | B2 * | 4/2017 | Kates | F24F 11/001 |
| 2007/0056299 | A1 | 3/2007 | Shankweiler | |
| 2007/0114293 | A1 | 5/2007 | Gugenheim | |
| 2009/0008463 | A1 | 1/2009 | Holland et al. | |
| 2010/0235004 | A1 * | 9/2010 | Thind | G05B 15/02 700/277 |
| 2013/0013119 | A1 | 1/2013 | Mansfield et al. | |
| 2013/0140016 | A1 | 6/2013 | Storm et al. | |
| 2014/0052300 | A1 | 2/2014 | Matsuoka et al. | |
| 2016/0018119 | A1 * | 1/2016 | Desmet | F04D 25/088 165/237 |

FOREIGN PATENT DOCUMENTS

| | | | |
|---|---|---|---|
| JP | H10238912 | A | 9/1998 |
| JP | 2004144351 | A | 5/2004 |

* cited by examiner

MULTI-ZONE INDOOR CLIMATE CONTROL AND A METHOD OF USING THE SAME

CROSS REFERENCE TO RELATED APPLICATIONS

The present application is related to, and claims the priority benefit of, U.S. Provisional Patent Application Ser. No. 61/993,579 filed May 15, 2014, the contents of which are hereby incorporated in their entirety into the present disclosure.

TECHNICAL FIELD OF THE DISCLOSED EMBODIMENTS

The presently disclosed embodiments generally relate to heating, ventilation, and air-conditioning (HVAC) systems, and more particularly, to a multi-zone indoor climate control and a method of using the same.

BACKGROUND OF THE DISCLOSED EMBODIMENTS

In a typical ducted heating, ventilation, and air conditioning ("HVAC") system, a single blower in an indoor air handler circulates air to various parts of an environment through a system of ducts. In a typical zoned HVAC system, the ducts are divided into several zones, one for each part of a building that is desired to be controlled independently of the other zones. Zoned HVAC systems require a large plenum with smaller duct branches feeding conditioned air from the plenum to the interior space. A set of dampers are field installed into the duct branches, downstream of the supply plenum, with at least one damper for each zone. These dampers can be opened or closed, to direct more or less air to a particular zone as needed to satisfy the desired comfort level in that zone. Other means of increasing comfort includes additional HVAC systems to control other zones. The addition of dampers and additional HVAC systems increases the cost of installation. Moreover, the addition of dampers in existing homes is cost prohibitive, and in certain instances not possible due to access to duct work. There is therefore a need for a system and method to provide a balance of comfort needs in multiple zones without the need of additional equipment.

SUMMARY OF THE DISCLOSED EMBODIMENTS

In one aspect, a method of conditioning air within a multi-zone system using a controller in communication with at least one sensor located within at least one of a plurality of the zones. The method includes the step of operating at least one sensor to measure at least one environmental condition within at least one of the plurality of zones.

The method further includes the step of identifying which, if any, of the plurality of zones is occupied. The method further includes the step of determining whether a demand condition exists within at least one occupied zone. An example of a demand condition occurs when there is a difference between the desired environmental condition (e.g. temperature or humidity) and the actual environmental condition within each of the zones. If a demand condition does not exist within an occupied zone, the method returns to step of operating the at least one sensor to measure at least one environmental condition within at least one of the plurality of zones.

If it is determined that two or more occupied zones have a demand condition, the method proceeds to step of calculating the difference between the actual environmental condition and the desired environmental condition within the plurality of zones to create a zone demand value.

The method proceeds to step of determining whether a cumulative zone demand value is equal to a zone balance point value. In at least one embodiment, the cumulative zone demand value is equal to the sum of each zone demand value. In at least one embodiment, the zone balance point value is adjustable. In at least one embodiment, the zone balance point value includes a temperature. In at least one embodiment, the zone balance point value includes a temperature between approximately −3° to +3° F. In at least one embodiment, the zone balance point value includes a relative humidity. In at least one embodiment, the zone balance point value includes a relative humidity between approximately −5% to 5%.

If the cumulative zone demand value is not equal to the zone balance point, then the method proceeds to step of operating at least one HVAC component to condition air within each of the zones. In at least one embodiment, operating the at least one HVAC component to condition air includes operating in a cooling mode. In at least one embodiment, operating the at least one HVAC component to condition air includes operating in a heating mode.

As the air is conditioned within zones, the method returns to step of calculating the difference between the actual environmental condition and the desired environmental condition within each of the zones to create a zone demand value in an attempt to balance over-conditioning and under-conditioning within the zones.

In at least one embodiment, if the cumulative zone demand value is equal to the zone balance point, the method proceeds to step of stopping operation of the at least one HVAC component. In another embodiment if the cumulative zone demand value is equal to the zone balance point, the method proceeds to step of operating the at least one HVAC component in a continuous fan mode.

Returning to the step of determining whether the occupied zone has a demand condition; if it is determined that one occupied zone has a demand condition, the method proceeds to step of operating the at least one HVAC component to condition air within the plurality of zones. In at least one embodiment, operating the at least one HVAC component to condition air includes operating in a cooling mode. In at least one embodiment, operating the at least one HVAC component to condition air includes operating in a heating mode.

The method then proceeds to the step of determining whether the demand condition has been satisfied. A demand condition is satisfied if the actual environmental condition is equal to the desired environmental condition. If the demand condition has been satisfied, the method proceeds to the step of stopping operation of the at least one HVAC component. If the demand condition has not been satisfied, the method proceeds to the step to determine whether the actual environmental condition within the zone designated as unoccupied has reached an over-conditioned limit.

If the over-condition limit has been reached within the zone designated as unoccupied, the method proceeds to step of operating the at least one HVAC component in a continuous fan mode. If the over-condition limit has not been reached, the method returns to step of operating the at least one HVAC component to condition air within each of the zones.

In one aspect, an HVAC system configured to condition air within a multi-zone system is provided. The HVAC system includes at least one HVAC component configured to condition air within at least two zones of a structure. The HVAC system further includes a main controller, including at least one main sensor disposed therein. The main controller is in electrical communication with the at least one HVAC component. The main controller is in further electrical communication with at least one auxiliary sensor located within another zone.

In one aspect, an HVAC control system is provided: The HVAC control system includes a plurality of sensors, each of the plurality of sensors capable of sensing at least one environmental condition in an associated HVAC zone, and a controller, configured to receive sensed environmental conditions from the plurality of sensors; and further configured to control an HVAC unit associated with at least two HVAC zones based on the sensed environmental signals from those at least two HVAC zones. In one embodiment, the HVAC unit is a single HVAC unit. In one embodiment, the controller is configured to control a heating unit and a cooling unit associated with the at least two HVAC zones. In one embodiment, the controller is configured to control the HVAC unit further based on a user customizable control algorithm.

BRIEF DESCRIPTION OF THE DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
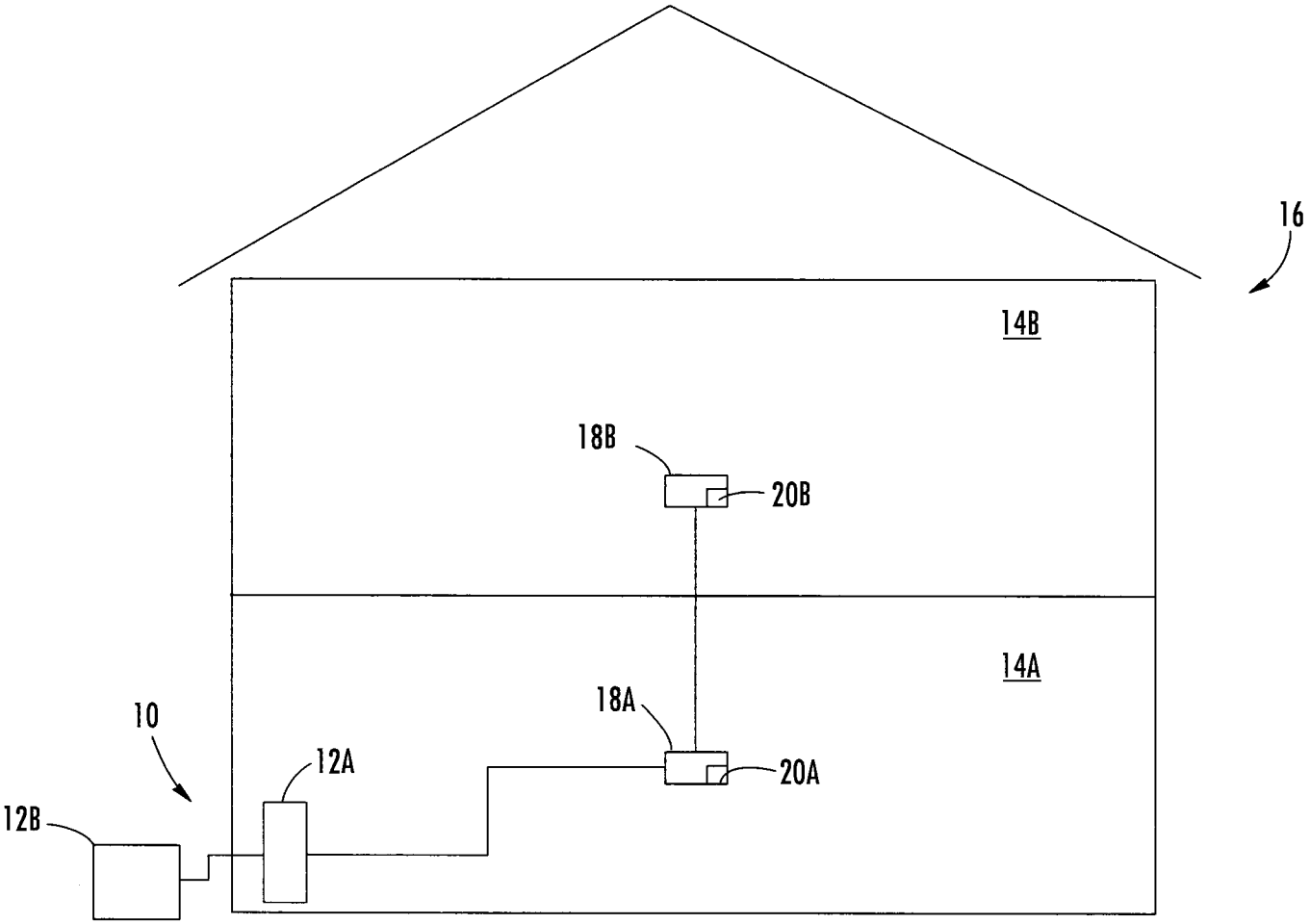
FIG. 1 is a schematic component diagram of a HVAC system.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 is a schematic view of an HVAC system generally indicated at 10. The HVAC system includes at least one HVAC component 12 configured to condition air within at least two zones 14 of a structure 16. It will be appreciated that the structure 16 may include more than two zones. For example, the at least one HVAC component 12 may include a furnace, fan coil, air conditioner, heat pump, geothermal heat pump, humidifier, dehumidifier, indoor air quality system, etc., to name a few non-limiting examples. In the example shown, the at least one HVAC component 12A includes a furnace, and the at least one HVAC component 12B includes an air conditioner. The HVAC system 10 further includes a main controller 18A, including at least one main sensor 20A disposed therein. It will be appreciated that the at least one main sensor 20A need not be disposed within the main controller 18A. The main controller 18A is in electrical communication with the at least one HVAC component 12. The at least one main sensor 20A is configured to measure environmental conditions, for example temperature and humidity to name a couple of non-limiting examples, within the zone 14A where the main controller 18A is located. It will also be appreciated that the main controller 18A may be in electrical communication with the at least one HVAC component 12 via a wired or wireless connection. In the example shown, the main controller 18A, located within zone 14A, is in electrical communication with HVAC component 12A. The main controller 18A is in further electrical communication with at least one auxiliary sensor 20B located within the zone 14B. The at least one auxiliary sensor 20B is configured to measure environmental conditions, for example temperature and humidity to name a couple of non-limiting examples, within the zone 14B where the auxiliary sensor 20B is located. In the example shown, auxiliary sensor 20B is disposed within auxiliary controllers 18B, located within zone 14B. It will be appreciated that the auxiliary sensor 20B need not be disposed within an auxiliary controller 18B. It will also be appreciated that the main controller 18A may be in electrical communication with the at least one auxiliary sensor 20B via a wired or wireless connection.

Figure 2:
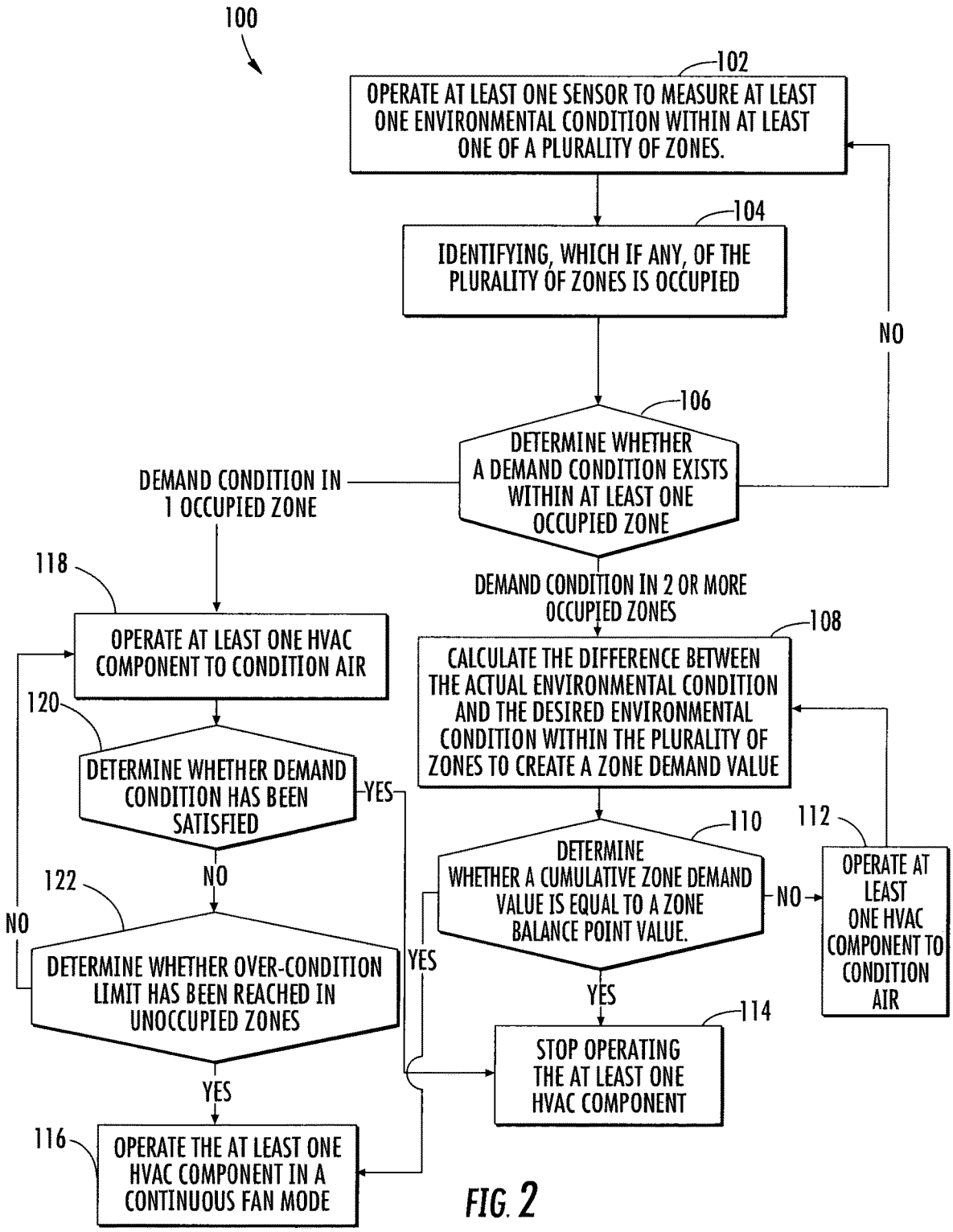
FIG. 2 is a schematic flow diagram of a method for a multi-zone indoor climate control.

FIG. 2 illustrates a schematic flow diagram of an exemplary method 100 of a multi-zone indoor climate control using a main controller 18A, including a main sensor 20A, in communication with at least one auxiliary sensor 20B located within at least one of a plurality of zones 14. The method 100 includes the step 102 of operating the at least one sensor 20 to measure at least one environmental condition within at least one of the plurality of zones 14. For example, the main sensor 20A and the auxiliary sensor 20B measure the temperature and/or humidity within each of the zone 14A and 14B, respectively.

The method further includes the step 104 of identifying, which, if any, of the plurality of zones 14 is occupied. For example, a user may designate a zone 14 as occupied when the user is present within the particular zone 14, and designate a zone 14 as unoccupied when the user is absent from the particular zone 14. It will be appreciated that a user may designate any zone as occupied or unoccupied without having to be physically present within a particular zone 14. For example, a user may designate a particular zone as being occupied without being physically present to begin pre-conditioning of the zone with the anticipation that the user will be present in the near future.

The method further includes step 106 of determining whether a demand condition exists within at least one occupied zone 14. An example of a demand condition occurs when there is a difference between the desired environmental condition (e.g. temperature or humidity) and the actual environmental condition within each of the zones 14. If a demand condition does not exist within any zone 14, the method returns to step 102 of operating the at least one sensor 20 to measure at least one environmental condition within at least one of the plurality of zones 14. For example, a user may designate a zone 14 as occupied when the user is present within the particular zone 14, and designate a zone 14 as unoccupied when the user is absent from the particular zone 14. It will be appreciated that a user may designate any zone as occupied or unoccupied without having to be physically present within a particular zone 14. For example, a user may designate a particular zone as being occupied without being physically present to begin pre-conditioning of the zone with the anticipation that the user will be present in the near future.

If a demand condition exists within an occupied zone 14, the method proceeds to step 106 of determining whether a demand condition exists within at least one occupied zone 14.

If it is determined that two or more occupied zones 14 have a demand condition, the method proceeds to step 108 of calculating the difference between the actual environmental condition and the desired environmental condition within the plurality of zones 14 to create a zone demand value. For example, if zones 14A and 14B are designated as occupied, main controller 18A and auxiliary controller 18B determine if a demand condition exists within each zone 14A or 14B, respectively. If the desired temperature set point within zone 14A is 70° Fahrenheit (F), and the actual temperature within zone 14A is 71° F., either controller 18A or auxiliary controller 18B will calculate the zone demand value within zone 14A to be 1° F. (71−70). If the desired temperature set point within zone 14B is 70° F., and the actual temperature set point within zone 14B is 74° F., either controller 18A or auxiliary controller 18B will calculate the zone demand value within zone 14B to be 4° F. (74−70). As an alternative example, if the desired temperature set point within zone 14A is 71° F., and the actual temperature within zone 14A is 70° F., either controller 18A or auxiliary controller 18B will calculate the zone demand value within zone 14A to be −1° F. (70−71). If the desired temperature set point within zone 14B is 74° F., and the actual temperature set point within zone 14B is 70° F., either controller 18A or auxiliary controller 18B will calculate the zone demand value within zone 14B to be −4° F. (70−74).

The method proceeds to step 110 of determining whether a cumulative zone demand value is equal to a zone balance point value. In at least one embodiment, the cumulative zone demand value is equal to the sum of each zone demand value. In at least one embodiment, the zone balance point value is adjustable. In at least one embodiment, the zone balance point value includes a temperature. In at least one embodiment, the zone balance point value includes a temperature between approximately −3° to +3° F. It will be appreciated that in situations where the user wishes to over-condition the zones, the user may set the zone balance point to a negative value, and in situations where the user desires to under-condition the zones, the user may set the zone balance point to a positive value. It will also be appreciated that the zone balance point value includes a temperature between approximately −1.5° to +1.5° C. In at least one embodiment, the zone balance point value includes a relative humidity. In at least one embodiment, the zone balance point value includes a relative humidity between approximately −5% to 5%. For example, if the zone demand value within zone 14A is +1° F., and if the zone demand value within zone 14B is −4° F. either main controller 18A or auxiliary controller 18B calculates the cumulative zone demand value to be −3° F. (+1°+−4°). If the user sets the zone balance point value to 0° F., either main controller 18A or auxiliary controller 18B determines whether the cumulative zone demand value (−3° F.) is equal to the zone balance point value (0° F.).

If the cumulative zone demand value is not equal to the zone balance point, then the method proceeds to step 112 of operating at least one HVAC component 12 to condition air within each of the zones 14. In at least one embodiment, operating the at least one HVAC component 12 to condition air includes operating in a cooling mode. In at least one embodiment, operating the at least one HVAC component 12 to condition air includes operating in a heating mode. For example, as the desired temperature set points within zones 14A and 14B are lower than the actual temperature, the air conditioner and the furnace operate in a cooling mode to provide conditioned air within zones 14A and 14B. It will be appreciated that if the desired temperature set points were higher than the actual temperatures within zones 14A and 14B, the at least one HVAC components 12 would operate in a heating mode.

As the air is conditioned within zones 14A and 14B, the method returns to step 108 of calculating the difference between the actual environmental condition and the desired environmental condition within each of the zones 14 to create a zone demand value in an attempt to balance over-conditioning and under-conditioning within the zones. For example, as the at least one HVAC component 12 operates in a cooling mode, the actual temperature within zone 14A may be lowered to 68° F., and the actual temperature within zone 14B may be lowered to 72° F. Either main controller 18A or auxiliary controller 18B determines the zone demand value within zone 14A to be −2° F. (68−70) and the zone demand value within zone 14B to be +2° F. (72−70). Either main controller 18A or auxiliary controller 18B calculates the cumulative zone demand value to be 0° F. (−2°+2°). Either main controller 18A or auxiliary controller 18B now determines that the cumulative zone demand value is equal to the zone balance point (0° F.). In this example, the under-conditioning within zone 14A is balanced with the over-conditioning in zone 14B.

In at least one embodiment, if the cumulative zone demand value is equal to the zone balance point, the method proceeds to step 114 of stopping operation of the at least one HVAC component 12. In another embodiment if the cumulative zone demand value is equal to the zone balance point, the method proceeds to step 116 of operating the at least one HVAC component in a continuous fan mode. It will be appreciated that operating the at least one HVAC component 12 in a continuous fan mode maintains the circulation of air within the conditioned zones; thus, increasing the time that the zones are at the desired zone balance point.

Returning to step 106, if it is determined that one occupied zone has a demand condition, the method proceeds to step 118 of operating the at least one HVAC component 12 to condition air within the plurality of zones 14. In at least one embodiment, operating the at least one HVAC component 12 to condition air includes operating in a cooling mode. In at least one embodiment, operating the at least one HVAC component 12 to condition air includes operating in a heating mode.

The method then proceeds to step 120 of determining whether the demand condition has been satisfied. A demand condition is satisfied if the actual environmental condition is equal to the desired environmental condition. If the demand condition has been satisfied, the method proceeds to step 114 of stopping operation of the at least one HVAC component 12. If the demand condition has not been satisfied, the method proceeds to step 122 to determine whether the actual environmental condition within the zone designated as unoccupied has reached an over-conditioned limit. It will also be appreciated that zones designated as occupied may also have an over-conditioned limit, and as such operate according to the method as described herein should the over-condition limit be reached. For example, a user may set a temperature over-condition limit of 65° F. and 80° F. within any zone. This corresponds to a condition in which the actual temperature within the zone may not be below 65° F. or above 80° F. For example, if zone 14B is designated as occupied, the desired temperature set point is 70° F. and the actual temperature is 75° F.; furthermore, zone 14A is designated as unoccupied space, the actual temperature and the desired temperature set point of the zone 14A is 70° F., the at least one HVAC component 12 operates to satisfy the demand condition within zone 14B until the demand conditioned is satisfied, or the actual temperature within zone 14A reaches the over-condition limit (i.e. 65° F.).

If the over-condition limit has been reached within the zone designated as unoccupied, the method proceeds to step 116 of operating the at least one HVAC component in a continuous fan mode. If the over-condition limit has not been reached, the method returns to step 118 of operating the at least one HVAC component 12 to condition air within each of the zones 14.

It will therefore be appreciated that the present embodiments provide improvements in the comfort level of a structure having multiple zones without the additional expenses of utilizing multiple HVAC systems or a multi-zone damper control system by balancing over-conditioning and under-conditioning within the zones.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. HVAC control system comprising:

a plurality of sensors, each of the plurality of sensors capable of sensing at least one environmental condition in an associated HVAC zone; and a controller, configured to receive sensed environmental conditions from the plurality of sensors; further configured to control an HVAC unit associated with at least two HVAC zones based on the sensed environmental signals from those at least two HVAC zones; further configured to determine whether a first demand condition exists within a first one of the at least two HVAC zones based on a first difference between a first desired environmental condition and a first sensed environmental condition within the first one of the at least two HVAC zones;

further configured to determine whether a second demand condition exists within a second one of the at least two HVAC zones based on a second difference between a second desired environmental condition and a second sensed environmental condition within the second one of the at least two HVAC zones; further configured to determine a sum of the first difference and the second difference; further configured to control the HVAC unit to balance over-conditioning and under-conditioning within the first one and the second one of the at least two HVAC zones based on the sum;

wherein controlling the HVAC unit to balance over-conditioning and under-conditioning comprises determining whether the sum is equal to a zone balance point value, wherein the zone balance point value comprises a temperature.

2. The HVAC control system of claim 1, wherein the HVAC unit is a single HVAC unit.

3. The HVAC control system of claim 1, wherein the controller is configured to control a heating unit and a cooling unit associated with the at least two HVAC zones.

4. The HVAC control system of claim 1, wherein the controller is configured to control the HVAC unit further based on a user customizable control algorithm.

5. A method of conditioning air within a multi-zone system using a controller in communication with at least one sensor located within at least one of a plurality of zones, the method comprising:

operating the at least one sensor to measure at least one environmental condition within at least one of the plurality of zones;

identifying which, if any, of the plurality of zones is occupied;

calculating a first difference between a first actual environmental condition and a first desired environmental condition within a first one of the plurality of zones to create a first zone demand value;

calculating a second difference between a second actual environmental condition and a second desired environmental condition within a second one of the plurality of zones to create a second zone demand value;

summing the first zone demand value and the second zone demand value to determine a cumulative zone demand value; and determining whether the cumulative zone demand value is equal to a predetermined value, wherein the predetermined value comprises a zone balance point value, wherein the zone balance point value comprises a temperature;

operating at least one HVAC component to condition air if it is determined that the cumulative zone demand value is not equal to the predetermined value.

6. The method of claim 5, wherein the predetermined value is adjustable.

7. The method of claim 5, wherein the predetermined value comprises a value between approximately −3°-+3° F.

8. The method of claim 5, wherein the cumulative zone demand value is equal to the sum of each of a plurality of zone demand values including the first zone demand value and the second zone demand value.

9. The method of claim 5, wherein operating the at least one HVAC component to condition air comprises operating in a mode selected from the group consisting of: heating and cooling.

10. The method of claim 5, further comprising stopping operation of the at least one HVAC component to condition air if it is determined that the cumulative zone demand value is equal to the predetermined value.

11. The method of claim 5, further comprising operating at least one HVAC component in a continuous fan mode if it is determined that the cumulative zone demand value is equal to the predetermined value.

12. The method of claim 5 further comprising determining whether an over-condition limit has been reached within at least one of the plurality of zones.

13. The method of claim 12, further comprising operating the at least one HVAC component in a continuous fan mode if it is determined that the over-condition limit has been reached within at least one of the plurality of zones.

14. A method of conditioning air within a multi-zone system using a controller in communication with a first sensor located within a first zone and a second sensor located within a second zone, the method comprising:

operating the first sensor to measure at least one environmental condition within the first zone;

operating the second sensor to measure at least one environmental condition within the second zone;

identifying which, if any, of the first and second zones is occupied;

determining whether a first demand condition exists within the first zone, the first demand condition existing if a first difference between a first desired environmental condition and a first actual environmental condition within the first zone is less than or greater than zero;

determining whether a second demand condition exists within the second zone, the second demand condition existing if a second difference between a second desired environmental condition and a second actual environmental condition within the second zone is less than or greater than zero;

operating at least one HVAC component to condition air if the first demand condition exists, the first zone is occupied, and a sum of the first difference and the second difference is less than or greater than a predetermined value, wherein the predetermined value comprises a zone balance point value, wherein the zone balance point comprises a temperature;

determining whether the first demand condition has been satisfied; and determining whether an over-condition limit has been reached within the second zone.

15. The method of claim 14, wherein operating the at least one HVAC component to condition air comprises operating in a mode selected from the group consisting of: heating and cooling.

16. The method of claim 14, further comprising stopping operation of the at least one HVAC component to condition air if it is determined that the first demand condition has been satisfied.

17. The method of claim 14, further comprising operating the at least one HVAC component in a continuous fan mode if it is determined that the over-condition limit has been reached within the second zone.

18. An HVAC system configured to condition air within a multi-zone system, the HVAC system comprising:

at least one HVAC component;

at least one controller in communication with the at least one HVAC component; and a first sensor located within a first zone of the multi-zone system, wherein the first sensor is in communication with the controller;

a second sensor located within a second zone of the multi-zone system, wherein the second sensor is in communication with the controller;

wherein the first sensor is configured to measure a first environmental condition within the first zone, and wherein the second sensor is configured to measure a second environmental condition within the second zone;

wherein the controller is configured to receive the first and second environmental conditions, identify which, if any, of the first zone and the second zone is occupied, calculate a first difference between the first environmental condition and a first desired environmental condition within the first zone to create a first zone demand value, calculate a second difference between the second environmental condition and a second desired environmental condition within the second zone to create a second zone demand value, and determine whether a cumulative zone demand value is equal to a predetermined value, the cumulative zone demand value including a sum of the first zone demand value and the second zone demand value, wherein the predetermined value comprises a zone balance point value, wherein the zone balance point comprises a temperature;

wherein the controller is further configured to command the at least one HVAC component to condition air if it determined that the cumulative zone demand value is not equal to the predetermined value.

19. The HVAC system of claim 18, wherein the predetermined value is adjustable.

20. The HVAC system of claim 18, wherein the predetermined value comprises a value between approximately −3° to +3° F.

21. The HVAC system of claim 18, wherein the cumulative zone demand value is equal to the sum of the first zone demand value and the second zone demand value.

22. The HVAC system of claim 18, wherein the at least one HVAC component operates to condition air by operating in a mode selected from the group consisting of: heating and cooling.

23. The HVAC system of claim 18, wherein the controller is further configured to stop operation of the at least one HVAC component to condition air if it is determined that the cumulative zone demand value is equal to the predetermined value.

24. The HVAC system of claim 18, wherein the controller is further configured to command the at least one HVAC component to operate in a continuous fan mode if it is determined that the cumulative zone demand value is equal to the predetermined value.

25. The HVAC system of claim 18, wherein the controller is further configured to operate the a least one HVAC component to condition air if a demand condition exists in one occupied zone, determine whether the demand condition has been satisfied within the one occupied zone, and determine whether an over-condition limit has been reached within at least one of the first and second zones.

26. The HVAC system of claim 25, wherein the at least one HVAC component operates to condition air by operating in a mode selected from the group consisting of: heating and cooling.

27. The HVAC system of claim 25, wherein the controller is further configured to command the at least one HVAC component to stop operating to condition air if it is determined that the demand condition has been satisfied.

28. The HVAC system of claim 25, wherein the controller is further configured to command the at least one HVAC component to operate in a continuous fan mode if it is determined that the over-condition limit has been reached within at least one unoccupied zone.

* * * * *